United States Patent [19]

Baldwin et al.

[11] Patent Number: 4,559,153

[45] Date of Patent: Dec. 17, 1985

[54] METAL WORKING LUBRICANT

[75] Inventors: Bernard A. Baldwin; Harold W. Mark, both of Bartlesville, Okla.

[73] Assignee: Phillips Petroleum Company, Bartlesville, Okla.

[21] Appl. No.: 545,308

[22] Filed: Oct. 25, 1983

[51] Int. Cl.[4] ..... C10M 1/38

[52] U.S. Cl. ..... 252/48.6; 252/56 R; 72/41

[58] Field of Search ..... 252/48.6, 56 R; 72/41

[56] References Cited

U.S. PATENT DOCUMENTS

| | | | |
|---|---|---|---|
| 2,354,550 | 7/1944 | Rosen | 252/48.6 |
| 2,474,604 | 6/1949 | Wasson et al. | 252/48.6 |
| 2,884,379 | 4/1959 | Rudel et al. | 252/48.6 |
| 3,600,310 | 8/1971 | Eyres et al. | 252/48.6 |
| 3,755,176 | 8/1973 | Kinney et al. | 252/48.6 |
| 4,174,284 | 11/1979 | Borel et al. | 252/48.6 |

OTHER PUBLICATIONS

Bastian, E. L. H. Metal Working Lubricants 1951, pp. 11–12.

Hawley, Gessner G. The Condensed Chemical Dictionary 1977, pp. 500, 648.

Zintak, Dennis Improving Production with Coolants and Lubricants, 1982, p. 22.

*Primary Examiner*—Jacqueline V. Howard

*Attorney, Agent, or Firm*—Howard D. Doescher

[57] ABSTRACT

Metal working lubricating compositions useful as a precoating oil and as a coating and rolling operation, comprising mineral or synthetic oil and a sulfur containing carboxylic acid such as n-dodecylthioacetic acid and n-butylthioacetic acid. The composition can also contain vegetable oil or animal fat. The lubricant composition provided is particularly useful in the cold rolling of steel and other metals.

17 Claims, 2 Drawing Figures

4% PALM OIL
(LEAST DAMAGED SECTION)

SURFACE BEFORE TEST

4% PALM OIL
(MOST DAMAGED SECTION)

3% PALM OIL
+0.4% n-DODECYLTHIOACETIC ACID
(REPRESENTATIVE SECTION)

100μm .0101N

4% PALM OIL

3% PALM OIL
+0.1% n -BUTYLTHIOACETIC ACID

3% PALM OIL
+0.2% t -BUTYLTHIOACETIC ACID

3% PALM OIL
+0.2% n -BUTYLTHIOACETIC ACID

100μm .010 IN

METAL WORKING LUBRICANT

This invention relates to improved additives for lubricating compositions. In one aspect, this invention relates to lubricating compositions containing as an additive at least one sulfur-containing carboxylic acid. In accordance with another aspect, this invention relates to rolling oil lubricants containing at least one sulfur-containing carboxylic acid additive. In accordance with another aspect, this invention relates to a method of improving the physical properties of metal working lubricants by incorporating therein at least one sulfur-containing carboxylic acid.

The present invention is concerned with compositions useful in treating metal surfaces, particularly ferrous metals. It is especially concerned with oil compositions useful as coatings for protection of metal surfaces during storage and as lubricants during metal working operations, especially metal cold rolling operations.

BACKGROUND OF THE INVENTION

Various types of lubricant compositions have been used in metal working as, for example, in cold rolling processes involving ferrous metals. For the most part, however, such compositions provide inadequate lubrication or cause objectionable surface discoloration or imperfection. In many instances, they are ineffective in preventing the formation of rust during processing.

Rolling oils for metal fabrication historically have been based on vegetable and animal fatty acids. These fatty acids are often diluted with mineral oil. The primary purpose of these oils is to enhance the surface appearance of the finished metal product with anti-wear and lubrication being a necessary, but secondary, requirement. Although the addition of palm oils, for example, reduces the problems associated with the use of the base oil alone, there is still evidence of surface transfer of metals from the sheet to the rolls. Although this can lead to accelerated wear, the worst problem is the appearance of the final rolled sheet. If the final product contains chips or bumps and surface defects, it is often sent back to the furnace. In view of studies that have been made, palmitic acid provides lubricity but does not provide extreme pressure properties under the high loads produced by asperities on a microscopic level. In accordance with the invention, it has been found that the addition of a small amount of a sulfur-containing additive improves the extreme pressure properties of the lubricating oil.

Accordingly, an object of this invention is to provide improved additives for lubricating compositions.

Another object of this invention is to provide improved lubricating compositions utilizing the additives of the invention.

A further object of this invention is to provide an additive for oil-based industrial lubricants to improve the surface appearance of the work.

A further object of this invention is to provide rolling oils exhibiting reduced wear and improved surface appearance of the work.

Other objects, aspects, as well as the several advantages of the invention, will be apparent to those skilled in the art upon reading the specification and the appended claims.

SUMMARY OF THE INVENTION

Thus, according to the invention there is provided lubricating compositions exhibiting improved characteristics containing at least one sulfur-containing carboxylic acid.

In accordance with another embodiment of the invention, oil-based industrial lubricants are provided containing a small minor effective amount of at least one sulfur-containing carboxylic acid.

In accordance with still another embodiment of the invention, oil lubricants are provided comprising a mineral or synthetic oil, at least one sulfur-containing carboxylic acid, and optionally, a vegetable oil or animal fat.

Further, according to the invention, there is provided a method for improving the properties of rolling oils used for metal fabrication by incorporating therein a small but effective amount of at least one sulfur-containing carboxylic acid to reduce wear and improve appearance of parts in highly loaded contact.

DESCRIPTION OF SPECIFIC EMBODIMENTS

Figure 1:
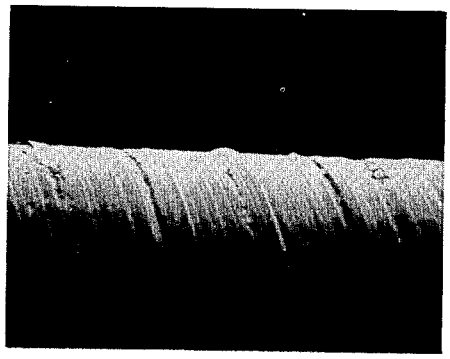
Figure 1:
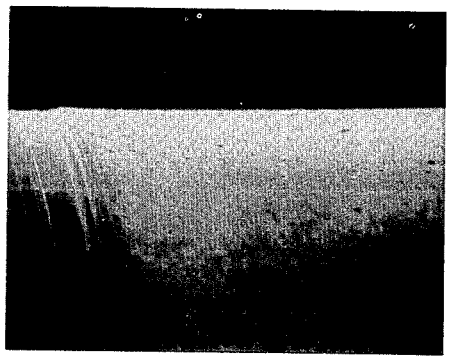
Figure 1:
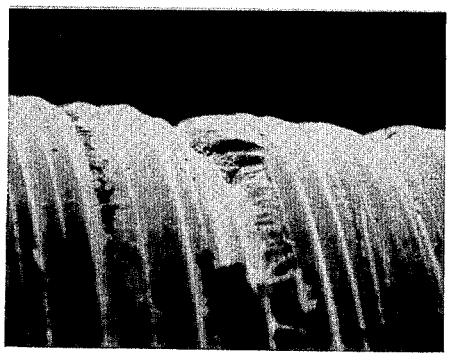
Figure 1:
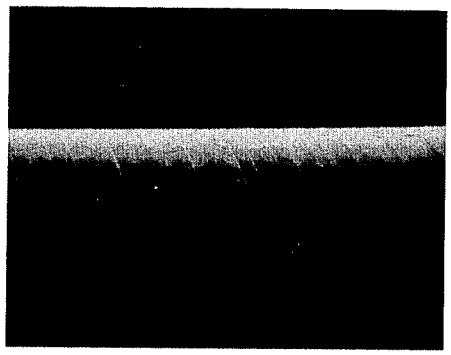

The oils in which the inventive additives are incorporated include any suitable mineral or synthetic oil of lubricating viscosity, such as those used for compounding lubricating oils of SAE 10 to SAE 50 viscosity. The synthetic oils include polyesters, phosphate polyesters, alkylated polyethers and hydrocarbon based oils. The preferred synthetic oils are hydrocarbon based such as hydrogenated polyalphaolefins and alkylated aromatics. The mineral oils can be derived from suitable naphthenic, paraffinic, and mixed base crudes as well as mixtures of one or more types. The additives of the invention have special advantages when employed with paraffinic types of oils, such as are obtained by solvent extraction of a suitable refinery stream. Many suitable lubricating compositions are available as commercial products, such as those used as motor oils, fuel oils, gear oils, aromatic transmission oils, heavy oils, and the like. The present invention additives are found to be particularly suitable for incorporation into rolling oils used during metal fabrication.

The mineral or synthetic oil is present in amounts ranging from about 0 percent to about 99 percent by weight of the composition and preferably from about 60 percent to about 98 percent by weight, and more preferably 92 to 98 weight percent.

The additives of the invention are sulfur-containing carboxylic acids having the formula $$R—S—R'CO_2H$$

or $$[—R—S—R'CO_2H]_2$$

wherein R is an alkyl or alkylene or from 1 to about 20 carbon atoms, and R' is an alkylene of from 1 to about 6 carbon atoms, and further wherein R is preferably a normal alkyl group having from 2 to 12 carbon atoms.

Representative examples of suitable compounds that can be used falling within the scope of the above-described formulas include n-dodecylthioacetic acid, also named 3-thiapentadecanoic acid (n-$C_{12}H_{25}$—S—$CH_2CO_2H$), n-octylthiopropionic acid (n-$C_8H_{17}$—S—$C_2H_4CO_2H$), n-butyl thioacetic acid (n-$C_4H_9$—S—$CH_2CO_2H$), t-butylthioacetic acid (t-

$C_4H_9$—S—$CH_2CO_2H$), isopropylthioacetic acid (i-$C_3H_7$—S—$CH_2CO_2H$), and the like, and mixtures thereof. An example of sulfur-containing dimer acids are 3,8-dithiadecanedioic acid ([—$C_2H_4$—S—$CH_2CO_2H$]$_2$) and 3,6-dithiaoctandioic acid ([—$CH_2$—S—$CH_2CO_2H$]$_2$).

The amount of sulfur-containing carboxylic acids added to the oil will be an amount sufficient to improve the extreme pressure properties of the oil and, at the same time, provide a lubricating composition that will provide reduced wear and improved appearance of parts in highly loaded contact. The acid can be present in the range of about 0.1 to about 10 weight percent of the finished oil, preferably 0.1 to about 2 weight percent of the lubricant.

An optional third component is commonly used in rolling oils, namely, fatty oils such as palm oil or lard oil, fatty acids such as palmitic, lauric acids, aliphatic monocarboxylic acids having 12 to 30 carbon atoms. These can be present in the range of 0 up to about 99.9 weight percent, preferably 1–6 weight percent of the finished oil.

Additives other than those which are mentioned above can be present in the lubricating composition, such as emulsifiers, anti-oxidants, and the like, at concentrations of up to about 5 percent by weight of the finished oil.

The components are blended together using conventional mixing such as stirring. Heating may be used to facilitate blending, e.g., temperatures of from 80° F. to 120° F. The sulfur-containing carboxylic acid may be prepared using known methods such as disclosed in U.S. Pat. No. 3,755,176 which is incorporated herein by reference.

The effectiveness of the herein-described sulfur-containing carboxylic acid alone or together with palm oil in rolling oils is demonstrated by the following examples.

EXAMPLE I

Comparative Extreme Pressure Lubricant Properties

The test used was the well-known Shell 4-Ball Wear Test using a 20 kg load. The base oil was a paraffinic mineral oil having viscosity of 79 cSt at 38° C., 8.3 cSt at 100° C. This is SAE 20 grade oil.

| Scar Diameter and Frictional Force | | | |
|---|---|---|---|
| Additive | Wt. % Additive | Wear Scar (mm) | Frictional Force (Kg) |
| None | — | 0.61 | 0.070 |
| Palm oil | 3 | 0.66 | 0.077 |
| n-dodecylthioacetic acid | 0.4 | 0.56 | 0.082 |
| n-dodecylthioacetic acid | 0.4 | 0.52 | 0.048 |
| + palm oil | 3 | | |
| n-butylthioacetic acid | 0.22 | 0.56 | 0.080 |
| n-butylthioacetic acid | 0.23 | 0.56 | 0.041 |
| + palm oil | 3 | | |

The results show that addition of n-butyl- or n-dodecylthio acetic acid to mineral oil or mineral oil plus palm oil significantly improves the extreme pressure lubricant properties.

EXAMPLE II

Comparative Surface Wear Properties

The test used was the well known Falex Lubrication Test. The base was the same mineral oil of Example I.

| WEAR AND COEFFICIENT OF FRICTION | | | |
|---|---|---|---|
| Additive | Wt. % Additive | Wear (mm) | Coef. of Friction |
| Palm oil | 1.6 | 0.0991 | 0.082 |
| n-dodecylthioacetic acid | 0.1 | 0.0767 | 0.087 |
| + palm oil | 1.5 | | |
| n-dodecylthioacetic acid | 0.4 | 0.0142 | 0.071 |
| + palm oil | 1.2 | | |
| n-dodecylthioacetic acid | 0.8 | 0.00610 | 0.066 |
| + palm oil | 0.8 | | |
| n-dodecylthioacetic acid | 1.7 | 0.00914 | 0.070 |

Micrographs of the surface of the Steel Falex pin are shown after being tested with palm oil, and palm oil with (1) n-dodecylthioacetic acid, (2) n-butylthioacetic acid, and (3) t-butyl thioacetic acid are shown in the figures.

FIG. 1 shows a steel Falex pin after 3 hours of sliding under an applied load of 118 KG using n-dodecylthioacetic acid as the additive. Except for a few light grooves, the surface finish of the pin tested with 0.4 percent n-dodecylthioacetic acid is identical to the original unworn surface. The improvement over palm oil alone is remarkable.

Figure 2:
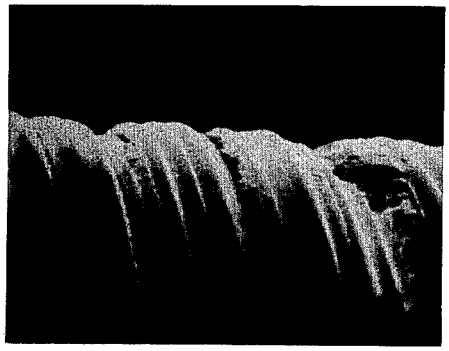
Figure 2:
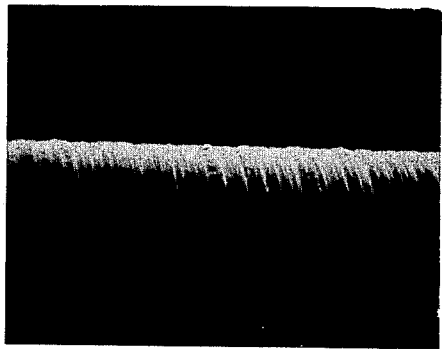
Figure 2:
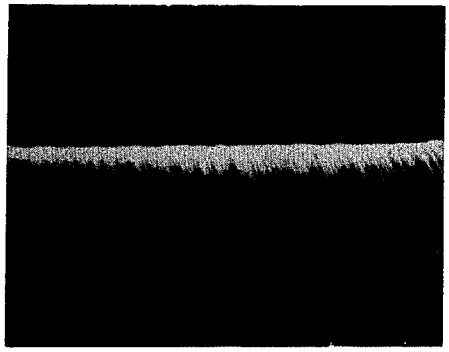
Figure 2:
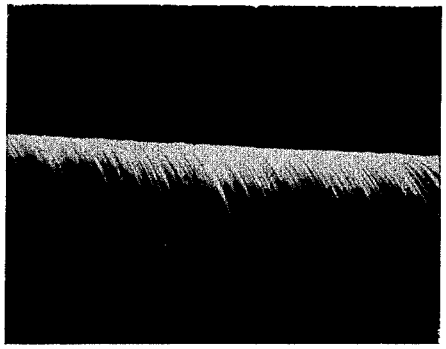

FIG. 2 shows the steel Falex pin tested with n-butylthioacetic acid and butylthioacetic acid. The improvement over palm oil alone is again remarkable. These materials are slightly less effective than n-dodecylthioacetic acid but they function at lower concentrations. In addition, they are liquids which aid handling.

These results show the decreased wear and coefficient of friction and the smoother surface result from use of the inventive compositions.

EXAMPLE III

Comparative Corrosion Properties

The test used was ASTM D130, a standard test for copper corrosion by petroleum products. Mineral oil was the base oil.

| Copper Corrosion | | |
|---|---|---|
| Additive | Wt. % Additive | Corrosion Value |
| palm oil | 4.0 | 1a |
| n-dodecylthioacetic acid | 1.6 | 1a |
| n-dodecylthioacetic acid | 0.4 | 1a |
| + palm oil | 3.0 | |

This test shows that the additives do not corrode copper.

We claim:

1. A lubricant composition for metal fabrication comprising a major proportion of a mineral or synthetic oil having incorporated therein (1) from 0.1 to about 10 percent by weight of the finished composition of at least one alkylthiohydrocarbylcarboxylic acid and (2) from 1–6 weight percent of a vegetable oil or animal fat sufficient to improve extreme pressure properties of the oil and to reduce wear and improve surface appearance of parts in highly loaded contact.

2. A composition according to claim 1 wherein said acid has the formula:

R—S—R'$CO_2H$ or $[-R-S-R'CO_2H]_2$ wherein R is an alkyl or alkylene group having from about 1 to about 20 carbon atoms, and R′ is an alkylene having from 1 to about 6 carbon atoms.

3. A composition according to claim 2 which contains 0.1 to about 2 weight percent of said acid.

4. A composition according to claim 2 wherein said acid is n-dodecylthioacetic acid t-butylthioacetic acid or n-butylthioacetic acid.

5. A composition according to claim 4 which additionally contains palm oil or lard oil.

6. A rolling oil for metal fabrication comprising a major proportion of a mineral or synthetic oil having incorporated therein a minor effective amount of 0.1 to about 10 percent by weight of the finished composition of at least one alkylthioacetic acid and 1–6 percent by weight of a vegetable oil or animal fat.

7. A composition according to claim 6 which contains 0.1 to about 2 weight percent of said acid.

8. A composition according to claim 6 wherein the amount of acid ranges from 0.1 to about 2 weight percent and said acid is n-dodecylthioacetic acid t-butylthioacetic acid or n-butylthioacetic acid.

9. A composition according to claim 6 wherein said acid is n-dodecylthioacetic acid, t-butylthioacetic acid, or n-butylthioacetic acid and said vegetable oil or animal fat is palm oil or lard oil.

10. A method for improving the physical properties of rolling oils used for metal fabrication which comprises incorporating therein (1) from 0.1 to about 10 percent by weight of the finished composition of at least one alkylthiohydrocarbylcarboxylic acid, and (2) 1–6 weight percent of a vegetable oil or animal fat sufficient to improve the extreme pressure properties of the oil and to reduce wear and improve appearance of parts in highly loaded contact.

11. A method according to claim 10 wherein said acid has the formula:

$R-S-R'CO_2H$ or $[-R-S-R'CO_2H]_2$ wherein R is an alkyl or alkylene group having from about 1 to about 20 carbon atoms, and R′ is an alkylene having from 1 to about 6 carbon atoms.

12. In the treatment of metal surfaces with oil compositions during metal rolling and working operations, the step of applying a sufficient amount of a lubricant composition according to claim 2 to reduce wear and improve surface appearance of parts in highly loaded contact.

13. A method according to claim 12 which contains a fatty oil.

14. A method according to claim 12 wherein said acid is n-dodecylthioacetic acid t-butylthioacetic acid or n-butylthioacetic acid.

15. A method according to claim 14 which contains palm oil or lard oil.

16. A process according to claim 12 wherein said acid is an alkylthioacetic acid.

17. A method according to claim 16 wherein said acid is n-dodecylthioacetic acid, t-butylthioacetic acid, or n-butylthioacetic acid and said vegetable oil or animal fat is palm oil or lard oil.

* * * * *